US005829280A

United States Patent [19]

Chen

[11] Patent Number: 5,829,280

[45] Date of Patent: Nov. 3, 1998

[54] CABLE LOCKING DEVICE WITH AUTOMATIC POP-UP FEATURE

[75] Inventor: Jung-Tai Chen, Hsin Tien, Taiwan

[73] Assignee: Chong-Kuan Ling, Taipei, Taiwan

[21] Appl. No.: 951,368

[22] Filed: Oct. 16, 1997

[51] Int. Cl.[6] ..... E05B 61/06

[52] U.S. Cl. ..... 70/49; 70/58; 70/233; 70/386

[58] Field of Search ..... 70/18, 49, 58, 70/233, 386, DIG. 33, DIG. 36; 292/DIG. 72

[56] References Cited

U.S. PATENT DOCUMENTS

| | | | |
|---|---|---|---|
| 264,639 | 9/1882 | Donahue | 70/DIG. 36 X |
| 3,855,824 | 12/1974 | Falk | 70/49 X |
| 4,597,599 | 7/1986 | Bisbing | 292/DIG. 72 X |
| 4,633,689 | 1/1987 | Wolniak et al. | 70/DIG. 36 X |
| 5,170,650 | 12/1992 | Kortenbrede | 70/386 X |
| 5,447,043 | 9/1995 | Hwang | 70/386 X |
| 5,664,445 | 9/1997 | Chang | 70/386 X |

*Primary Examiner*—Lloyd A. Gall
*Attorney, Agent, or Firm*—Bacon & Thomas

[57] ABSTRACT

A cable locking device with an automatic pop-up feature is provided. The cable locking device includes a main body and a cable having one end fixed to one side of the main body and the other end releasably fastened to and locked by a spring-biased locking mechanism mounted in the main body. The cable can be easily locked to the locking mechanism simply by snapping a locking head fixedly connected on the locking end of the cable to the locking mechanism. To unlock, the user needs just to insert the associated key of the locking device to the locking core of the locking device and turn it to the unlocking position. By a head pop-up mechanism, the locking head can be popped up to the outside of the main body. The operation of the cable locking device is thus very easy and effortless.

7 Claims, 10 Drawing Sheets

CABLE LOCKING DEVICE WITH AUTOMATIC POP-UP FEATURE

BACKGROUND OF THE INVENTION

1. Field of the Invention:

This invention relates to locking devices, and more particularly, to a cable locking device with an automatic pop-up feature for cable ring locks that are used, for example, on bicycles or motorcycles to prevent theft thereof 2. Description of Related Art:

A cable locking device is a ring lock which includes a cable having one end fixedly fastened to the locking device and the other end attached with a locking head and releasably locked to the same. When both ends of the cable are fastened to the locking device, a ring is formed, which can be used to coil around the wheels of bicycles or motorcycles to prevent theft thereof Conventional cable locking devices includes dial type and key type. In the case of the dial type, the user needs to hold the main body of the locking device with one hand, then use the other hand to set the correct dial number, and finally use the same hand to pull the locked end of the cable from the locking device. The operational steps are quite laborious and inconvenient to do. In the case of the key type, such as U.S. Pat. No. 5,170,650, the operational steps are even more inconvenient, in that, after the cable is unlocked, the user still needs to hold the key in the turned state to allow the cable to be withdrawable from the locking device. This usually causes strains to the hands, particularly the hand holding the key. There exists, therefore, a need for a new cable locking device that can allow the locked end of the cable to be automatically popped up from the locking device once it is unlocked.

Still another drawback of the conventional cable locking device is that the locking head of the cable can be inserted into and locked by the locking mechanism only when the locking device is in unlocking state. For instance, in the case of the dial type, the user needs to set the dial to the correct number before the locking head of the cable can be inserted into and locked by the locking mechanism, and in the case of the key type, the user needs to insert the key to the locking device and then turn the core member to the unlocking position before the locking head of the cable can be inserted into and locked by the locking mechanism. The operational steps of the conventional cable locking device are thus very laborious to do.

SUMMARY OF THE INVENTION

It is therefore an objective of the present invention to provide a cable locking device with an automatic pop-up feature which allows the locking head of the cable to be popped up automatically when the locking device is unlocked by using the key of the locking device, without requiring the user to manually pull the cable out from the main body of the locking device.

It is another objective of the present invention to provide a cable locking device with an automatic pop-up feature which allows the unlocked cable to be inserted into and locked by the locking device without having to use the key of the locking device.

It is a further objective of the present invention to provide a cable locking device with an automatic pop-up feature which utilizes an axial locking mechanism instead of a radial locking mechanism as in prior art that allows the locking device to be more easily operable than the prior art.

It is still a further objective of the present invention to provide a cable locking device with an automatic pop-up feature which allows the two ends of the cable to be freely rotatable when the cable is in locked state, allowing the user to easily and conveniently handle the locking device.

It is still a further objective of the present invention to provide a cable locking device with an automatic pop-up feature which allows the key of the locking device to be easily withdrawable from the key hole of the locking device after the locking device has been unlocked by the key, and also allows the unlocked cable to be easily relocked by the locking device.

It is still a further objective of the present invention to provide a cable locking device with an automatic pop-up feature which is simpler in structure than prior art so that assembly will be easy and manufacturing cost will be reduced.

In accordance with the foregoing and other objectives of the present invention, a cable locking device with an automatic pop-up feature is provided. The cable locking device of the invention includes the following constituent parts:

(a) a cable having a first end fixed to a fastening head and a second end fixed to a locking head having a ring slot formed around the surface thereof;

(b) a main body having a fastening means for fixedly fastening the fastening head of the cable thereto, the main body further being formed with a head hole which allows the fastening head to pass therethrough to the inside of the main body and at least one wedge-like protrusion on the inner wall thereof near the head hole;

(c) a locking core mounted in the main body, the locking core including an inner cylinder having a key hole for receiving a key of the locking device, the inner cylinder being connected to a locking tongue which is turnable when the key inserted in the key hole is turned, (d) a locking mechanism mounted in the main body, the locking mechanism having a hollowed inside partitioned by a separator into a tongue receptacle for receiving the locking tongue of the locking core therein and a head receptacle for receiving the locking head of the cable therein, the locking mechanism being formed with at least one ball hole used to hold a ball therein, the ball being abutted on the wedge-like protrusion on the inner wall of the main body when the locking mechanism is mounted in the main body;

(e) an elastic member mounted in the main body between the locking core and the locking mechanism, the elastic member applying both a radial bias and an axial bias to the locking mechanism, the axial bias urging the locking mechanism toward the head hole while the radial bias urging the ball to be shifted to the wedge-like protrusion and intruding into the hollowed inside of the head receptacle; and (f) a head pop-up mechanism mounted in the head receptacle in the locking mechanism, the head pop-up mechanism including an urging member and a compressed spring provided between the urging member and the separator, the spring applying a bias on the urging member toward the head hole.

With the foregoing cable locking device, when the locking head is inserted into the head hole intending to fasten and lock the locking head to the locking mechanism, the ball is being supported by the wedge-like protrusion to have part intruding the hollowed inside of the head receptacle, thereby allowing the locking head to be shifted axially inwards by means of the urging member until the ball is shifted away from the wedge-like protrusion and retreated from the head receptacle, allowing the locking head to freely pass over the ball and entirely contained in the head receptacle; subsequently, when manual pushing force on the locking head is removed, the elastic member being released from compressed state to urge on and drive the locking mechanism back to original position, allowing the ball to again abut on the wedge-like protrusion and inset in the ring slot in the surface of the locking head, thereby latching the locking head securely in position.

Further, when the key of the locking device is inserted into the key hole in the inner cylinder and turned, the locking mechanism is turned correspondingly, allowing the ball to be shifted from the highest point of the wedge-like protrusion to the lowest point of the same and retreated from the head receptacle, allowing the compressed spring to be released and thus urge on the urging member to pop up the locking head to the outside of the main body. The operation of the cable locking device of the invention is thus very easy.

BRIEF DESCRIPTION OF DRAWINGS

The invention can be more fully understood by reading the following detailed description of the preferred embodiments, with reference made to the accompanying drawings, wherein.

DETAILED DESCRIPTION OF PREFERRED EMBODIMENTS

Figure 1A:
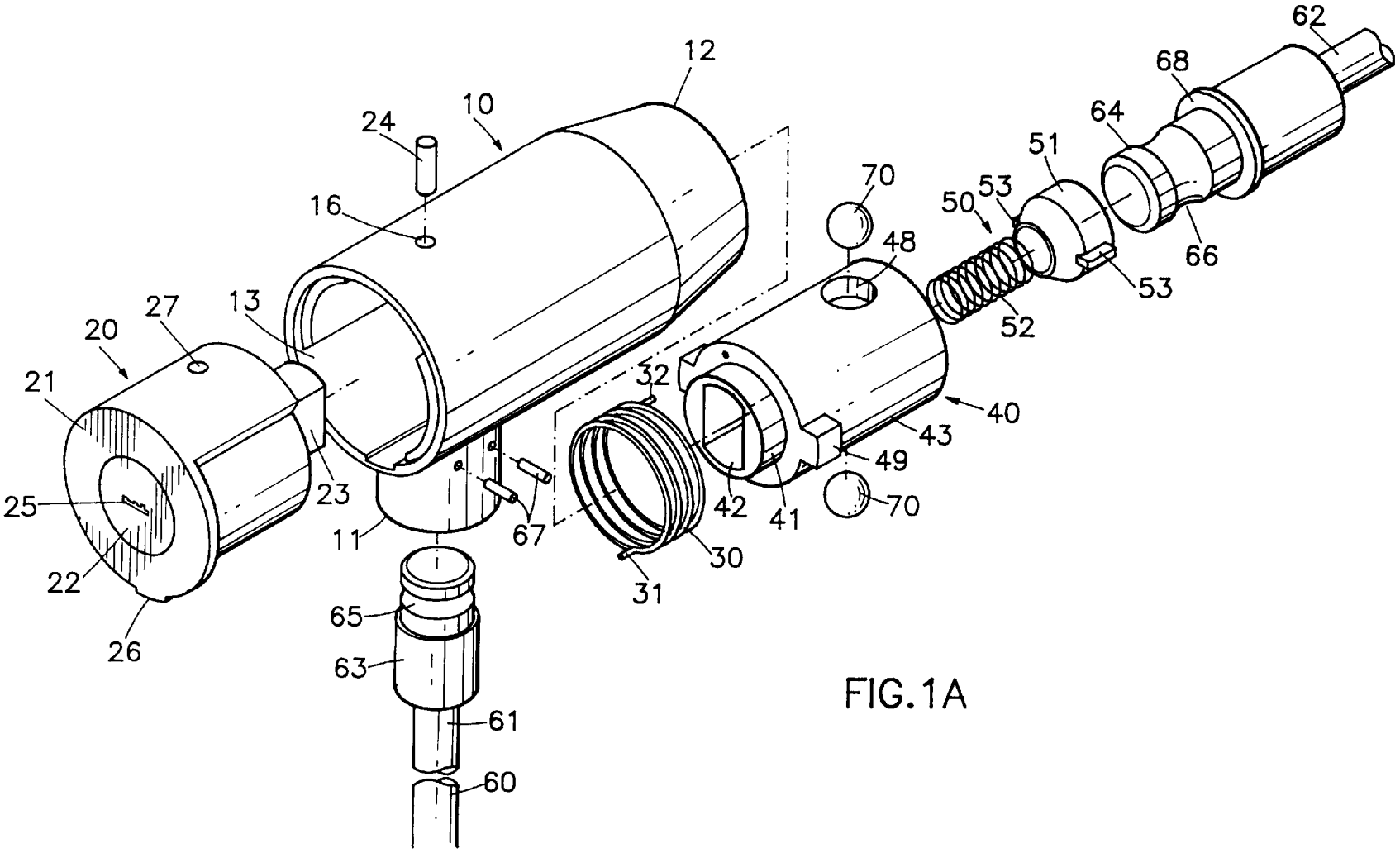
FIG. 1A is an exploded perspective view of the cable locking device with an automatic pop-up feature according to the invention.
Figure 1B:
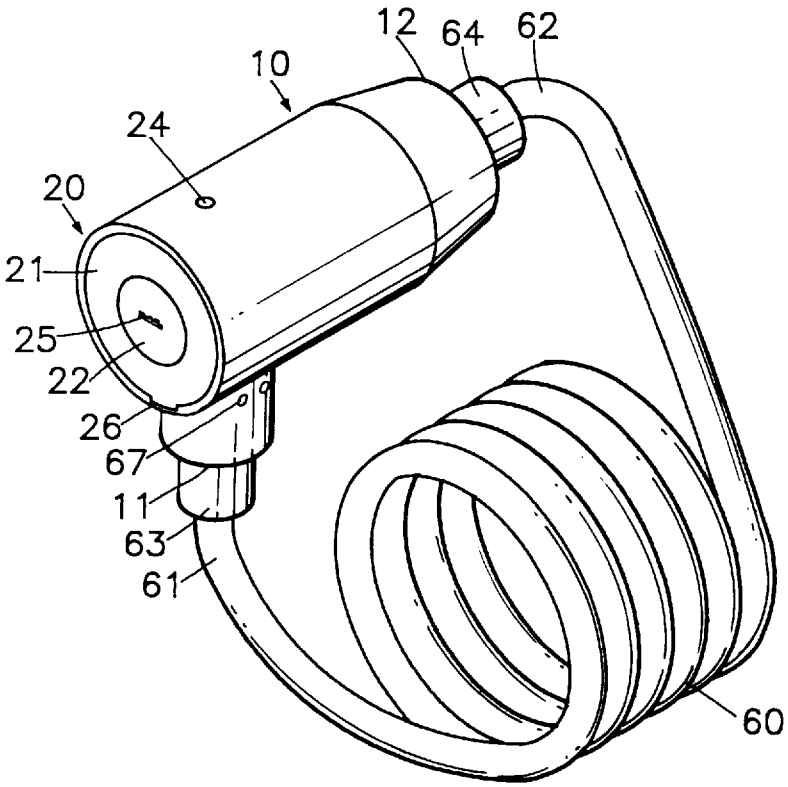
FIG. 1B is a perspective view of the cable locking device of the invention in the locked state.

Referring to FIGS. 1A and 1B, the cable locking device with an automatic pop-up feature according to the invention is composed of a main body 10 and a cable 60 having a first end 61 fixed to a permanent fastening head 63 and a second end 62 fixed to a releasable locking head 64. The fastening head 63 is formed with a ring slot 65 around the surface thereof, and similarly, the locking head 64 is formed with a ring slot 66 around the surface thereof. The main body 10 is formed with a receptacle 11 having a hollowed inside for receiving the fastening head 63 therein, with the fastening head 63 being securely fastened in position to the receptacle 11 by means of insetting two pins 67 through holes formed in the wall of the receptacle 11 to come into abutment on the ring slot 65 around the fastening head 63. The pins 67 stop the fastening head 63 from being withdrawable, thus allowing the fastening head 63 to be securely fastened to the receptacle 11 but rotatable on the same. The locking head 64 on the other end of the cable 60 can be inserted into a head hole 12 in the main body 10 of the locking device to be locked by the locking mechanism 40 such that the cable 60 can be fastened to the main body 10 to form a ring lock as shown in FIG. 1B. It is a main feature of the locking device of the invention that, when the locking head 64 is unlocked, it can pop up automatically away from the main body 10 without having to manually pull it. Detailed mechanism of this will be described in the following.

Figure 2:
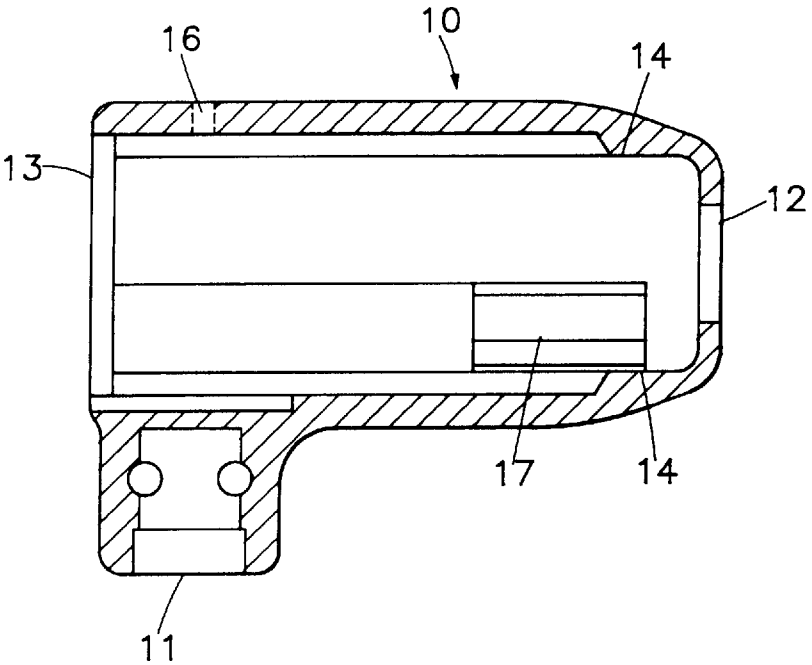
FIG. 2 is a longitudinal sectional diagram of the main body of the cable locking device of the invention.
Figure 9:
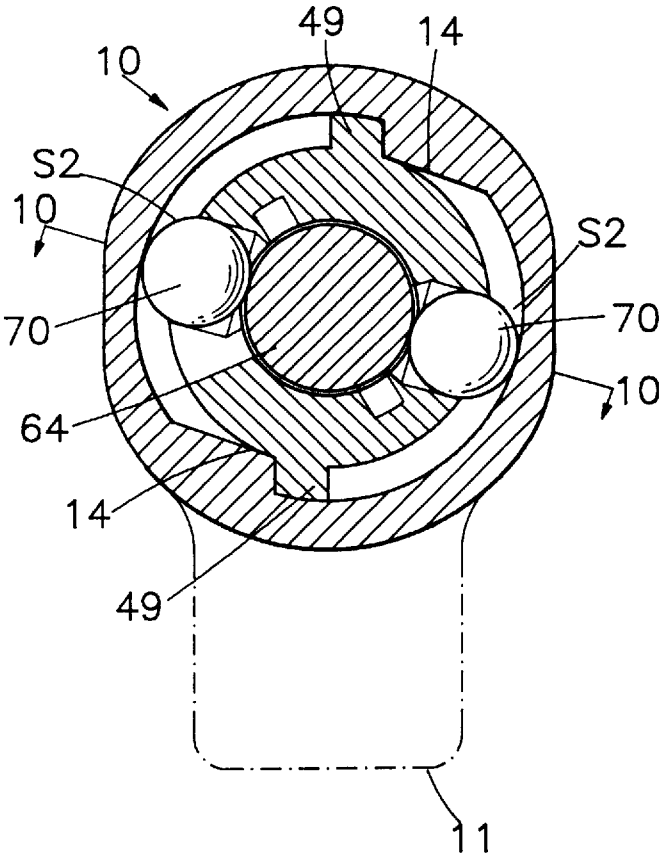
FIG. 9 is a cross sectional diagram of the same shown in FIG. 7 except for that herein the locking mechanism is turned to an unlocked position.

Referring also to FIG. 2, the main body 10 has a hollowed inside. The inner wall of the main body 10 is formed with wedge-like protrusions 14 having a radially inclined surface (as shown in FIGS. 8 and 9) and an axially included surface (as shown in FIGS. 4 through 7). The locking device further includes a locking core 20, an elastic member 30 such as a twist spring, a locking mechanism 40, and a head pop-up mechanism 50.

As shown in FIG. 1, the locking core 20 includes a casing 21 formed with a longitudinal protrusion 26 on its surface and an inner cylinder 22 having a key hole 25 formed on one side and a locking tongue 23 formed on the other side. The locking core 20 is mounted in position in the main body 10 by inserting it through an opening 13 formed on the other side of the main body 10, with the longitudinal protrusion 26 thereof sliding along an elongated longitudinal groove formed in the inner wall of the main body 10. Then, the locking core 20 is secured in position in the main body 10 by inserting a pin 24 through a hole 16 formed in the outer wall of the main body 10 and then a hole 27 in the casing 21 of the locking core 20. This allows the locking core 20 to be mounted securely, not able to be rotatable or shiftable, in the main body 10. The inner cylinder 22 and the locking tongue 23 are rotatable by inserting the key of the locking device into the key hole 25 and then manually turning the key of the locking device. In locked state, the inner cylinder 22 and locking tongue 23 are latched in position. Detailed mechanism of the casing 21 and inner cylinder 22 is conventional, so description thereof will not be further detailed.

Figure 4:
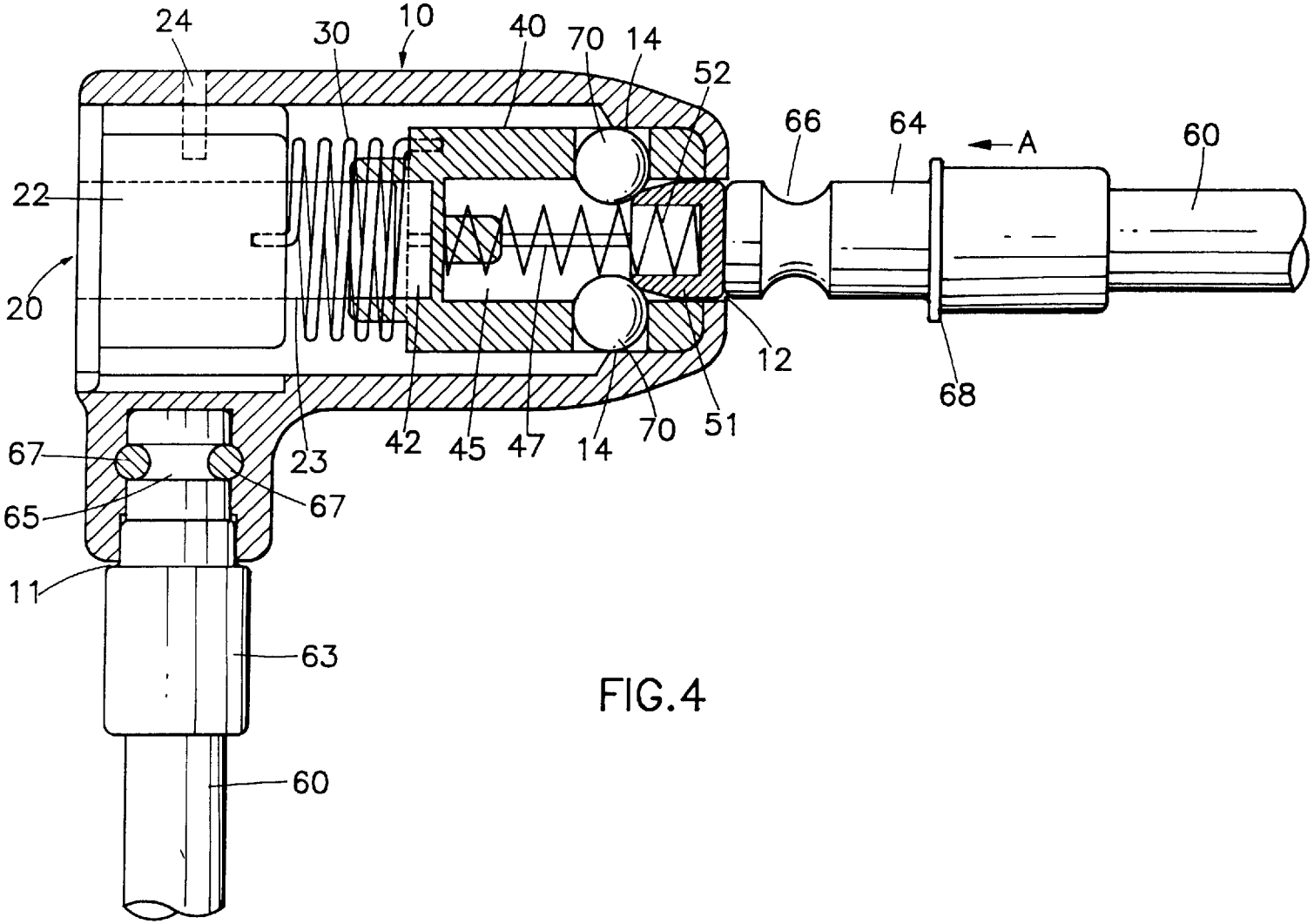
FIGS. 4 through 7 are longitudinal sectional diagrams of the cable locking device of the invention, which are respectively used to depict the step-by-step mechanical actions in the cable locking device of the invention.

Referring to FIG. 1 together with FIG. 4, the elastic member 30 is a twist spring having a first end 31 fixed to the casing 21 of the locking core 20 and a second end 32 fixed to the locking mechanism 40. The elastic member 30 allows the locking mechanism 40 to be biased axially repelling from the locking core 20 and radially tending to turn in a specific direction.

Figure 3:
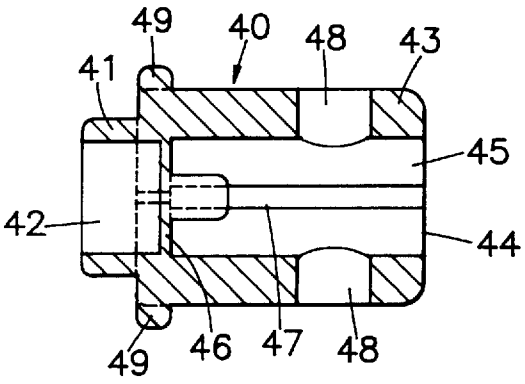
FIG. 3 is a longitudinal sectional diagram of a locking mechanism utilized in the cable locking device of the invention.

Referring to FIG. 1 together with FIG. 3, the locking mechanism 40 is substantially a cylindrical member having a hollowed inside which is partitioned by a separator 46 into a first receptacle 42 for receiving the locking tongue 23 therein and a head receptacle 45 for receiving the locking head 64 therein. The first receptacle 42 is formed into a shape that matches the shape of the locking tongue 23. When the user inserts the key of the locking device into the key hole 25 to turn the inner cylinder 22, the locking tongue 23 will be rotated to turn the locking mechanism 40. Due to the axial elastic force from the elastic member 30, the tip of the locking tongue 23 is separated from the innermost wall of the first receptacle 42 by a distance of about half of the depth of the first receptacle 42, resulting in an empty space that allow the locking mechanism 40 to be pushed by the locking core 20. A pair of axially symmetrical ball holes 48 are formed in the cylindrical surface near the opening 44 at the second end 43 of the locking mechanism 40, each being used to hold a steel ball 70 therein. Each of the ball holes 48 is smaller in diameter than the steel ball 70 in such a manner that, when the steel ball 70 is set therein, part of the steel ball 70 lies within the hollowed inside of the head receptacle 45. The hollowed inside of the head receptacle 45 is matched in shape to the locking head 64 of the cable 60 so that locking head 64 can be inserted snugly in the head receptacle 45. Further, the cylindrical surface of the locking mechanism 40 is formed with a pair of axially symmetrical ear-like portions 49 which can be inset in a corresponding pair of grooves 17 (see FIG. 2) formed in the inner wall of the main body 10. This allows the locking mechanism 40 to be axially movable while preventing angular movement of the same.

Referring to FIG. I together with FIG. 4, the head pop-up mechanism 50 is inset in the head receptacle 45 of the locking mechanism 40. The head pop-up mechanism 50 is composed of an urging member 51 and a compressed spring 52 mounted between the urging member 51 and the separator 46. The compressed spring 52 allows the urging member 51 to constantly provide an outward urging force. The urging member 51 is substantially a cylindrical member having an outer diameter substantially equal to the bore of the head receptacle 45. Further, the urging member 51 has a hollowed inside for receiving one end of the spring 52 that is fixed thereto. The other end of the spring 52 is fixed to the separator 46. The outer surface of the member 51 is formed with a pair of radially symmetrical guide ears 53 which are provided corresponding to a pair of guide grooves 47 and formed in the inner surface of the locking mechanism 40, allowing the urging member 51 to be axially slidable.

As shown in FIG. 4, in unlocked state when the key of the locking device is not being inserted in the key hole 25 and the locking head 64 of the cable 60 is not being inserted in the head hole 12, the inner cylinder 22 and locking tongue 23 are positioned in unlocking position. Since the locking mechanism 40 and the locking tongue 23 are subjected to both of the axial force and radial torque from the elastic member 30, the steel balls 70 are urged to abut on the highest point of the wedge-like protrusions 14, allowing part of the steel balls 70 to intrude the head receptacle 45. Further, in the unlocked state of the locking device, the urging member 51 in the head pop-up mechanism 50 is urged to a position between the head hole 12 and the steel ball 70 due to the elastic force from the spring 52.

To fasten and lock the cable 60 to the locking device, the user can manually insert the locking head 64 of the cable 60 into the head hole 12 in the main body 10. By doing this, the locking head 64 is locked to the locking device. The user needs not to use the key of the locking device to turn the inner cylinder 22 and the locking mechanism 40 to the unlocked state in order to receive the locking head 64 as required when using a prior art locking device.

The operational steps involved in the locking of the locking head 64 to the locking device are depicted in the following with reference to FIGs. 4 through 7

Referring first to FIG. 4, when the user inserts the locking head 64 into the head hole 12 in a direction as indicated by the arrow *A*, the urging member 51 is pushed inwards. Since part of the steel balls 70, which are supported by the respective wedge-like protrusions 14, intrudes into the hollowed inside of the head receptacle 45, the inward moving of the urging member 51 will cause the urging member 51 to urge on the steel balls 70 and the locking mechanism 40 against the opposing elastic force from the elastic member 30. As a result, the steel balls 70 will be shifted inwards until they are no longer supported by the wedge-like protrusions 14.

Figure 5:
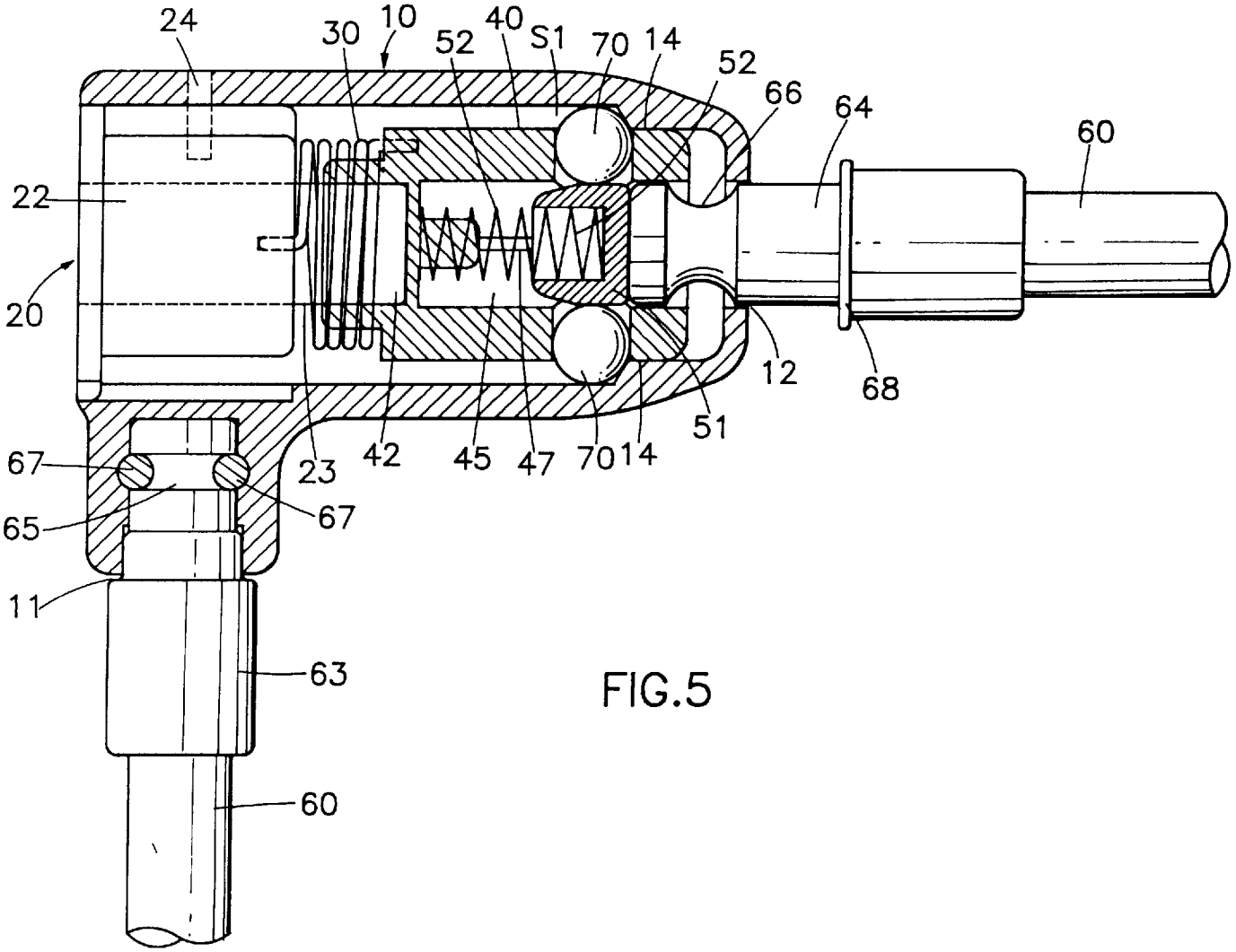

Referring further to FIG. 5, as the steel balls 70 are no longer supported by the wedge-like protrusions 14, they will be urged to shift radially outwards to the empty space S1 left between the locking mechanism 40 and the outer wall of the main body 10. As a result, the urging member 51 and the locking head 64 are no longer stopped by the steel balls 70 and the urging member 51 can keep moving inwards to pass over the steel balls 70 until the locking mechanism 40 is stopped by the fully compressed elastic member 30.

Figure 6:
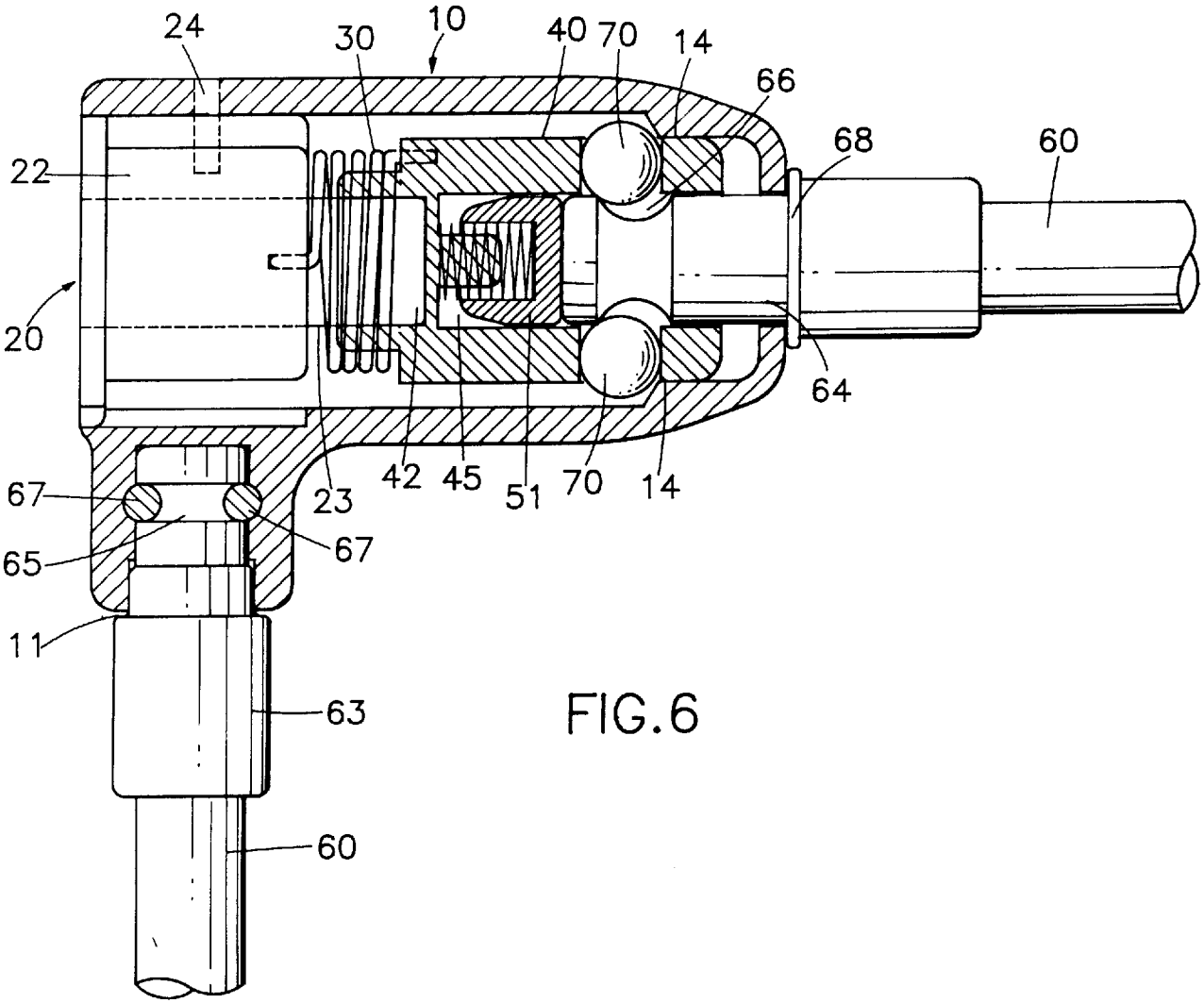

Referring further to FIG. 6, when the locking head 64 is pushed till the flanged portion 68 thereof meets the front end of the main body 10, it can no longer move in further. When the flanged portion 68 is stopped by the front end of the main body 10, the ring slot 66 of the locking head 64 is exactly located at a position where the steel balls 70 are currently located. Due to the opposing elastic force from the elastic member 30, the steel balls 70 can be pushed into the ring slot 66 of the locking head 64. At this time, the elastic member 30 and the spring 52 are both pushed to a compressed state.

Figure 7:
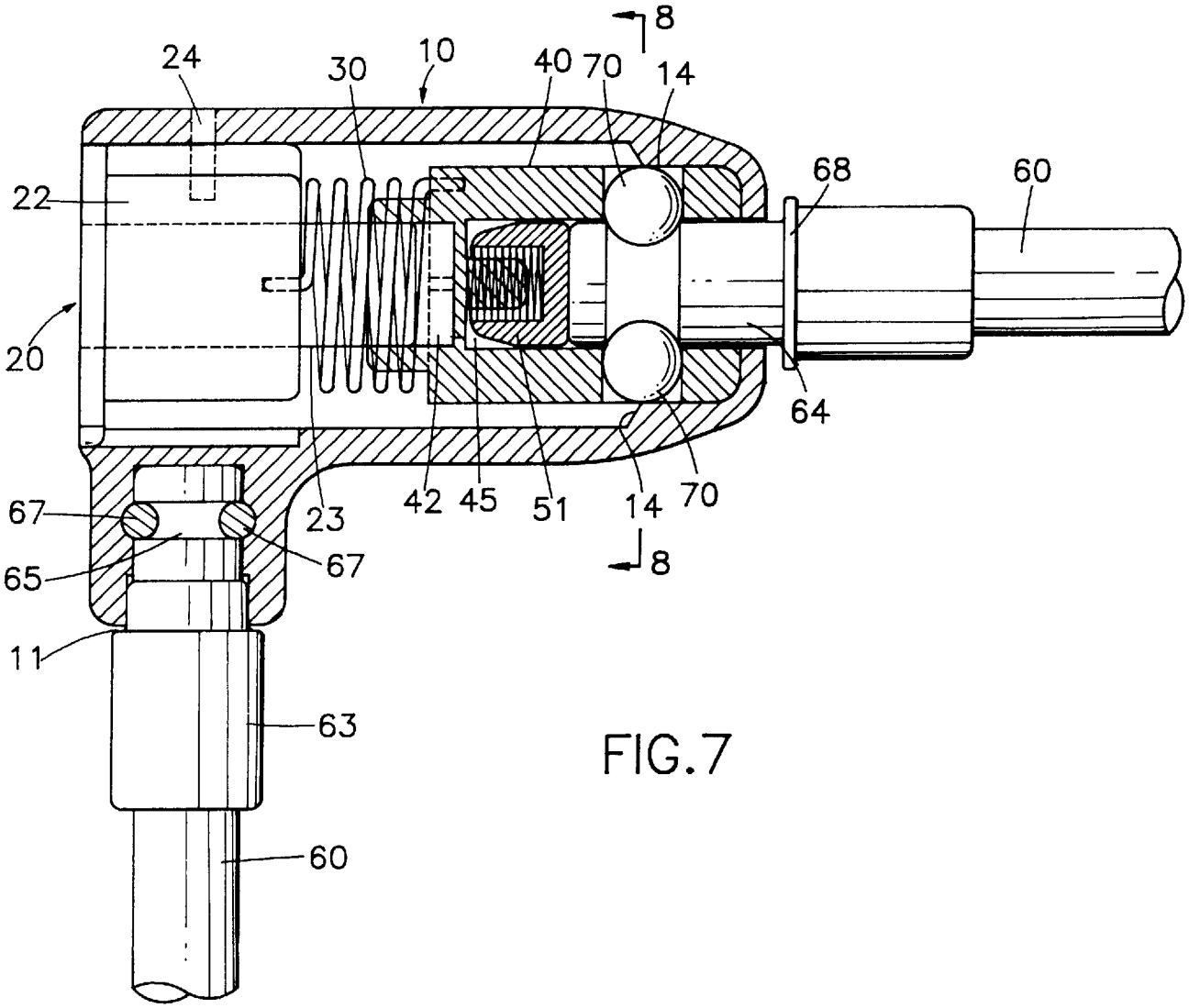
Figure 8:
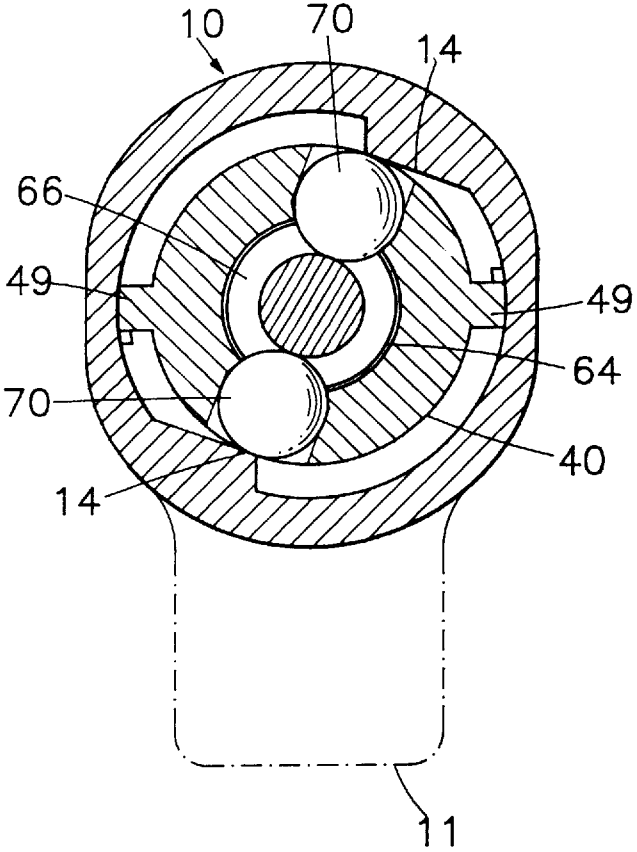
FIG. 8 is a cross sectional diagram of the cable locking device of the invention cutting through the line 8—8 in FIG. 7.

Referring further to FIGS. 7 and 8, the user can then free his/her hand from pushing the locking head 64. This allows the compressed elastic member 30 and the spring 52 to be release their elasticity forces which push the locking mechanism 40, the urging member 51, and the locking head 64 back to their original positions. The steel balls 70, however, are inset into the ring slot 66 of the locking head 64 to be shifted axially outwards with the locking head 64 and the locking mechanism 40 until the steel balls 70 are moved back to their original positions where they are abutted on the wedge-like protrusions 14. The steel balls 70 are therefore locked between the ring slot 66 and the wedge-like protrusions 14, thereby acting as a stopper that stops the locking head 64 to be further withdrawable. As a result, the locking head 64 is locked to the locking mechanism 40, which can be unlocked and withdrawable from the locking mechanism 40 only by using the key of the locking device. The cable is thus fastened to the main body 10 to form a ring lock. Since the elastic member 30 is larger both in size and elastic constant than the spring 52, the elastic member 30 can urge the locking mechanism 40 to move at a faster pace than the urging of the spring 52 on the locking head 64. Therefore, the steel balls 70 can be urged to enter the head receptacle 45 and then timely inset into the ring slot 66 of the slower moving locking head 64.

In this preferred embodiment, the steel balls 70 are ⅜ inch in diameter that act as a double-ball latching mechanism that can latch the locking head 64 securely in position in the locking mechanism 40. The steel balls 70 can be hardly unlatched by forcefully knocking on the main body 10 by the thieves. The locking device of the invention can thus provide a very reliable locking effect to the cable 60.

Figure 10:
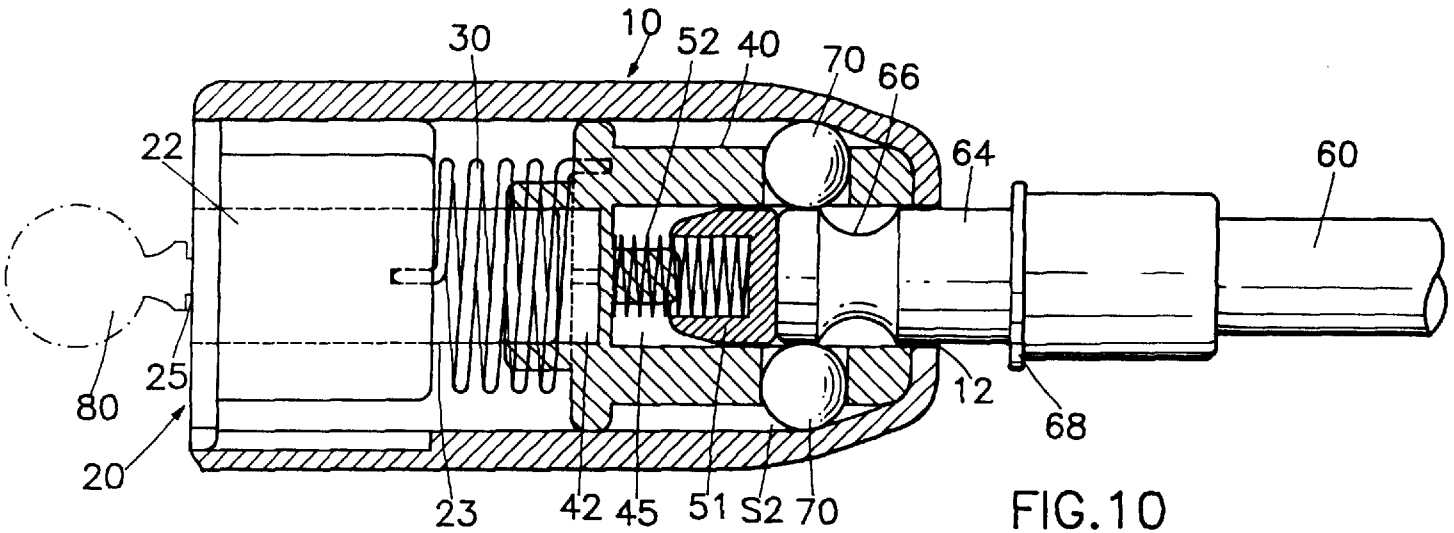
FIG. 10 is a longitudinal sectional diagram of the cable locking device of the invention cutting through the line 10-10 in FIG. 9.
Figure 11:
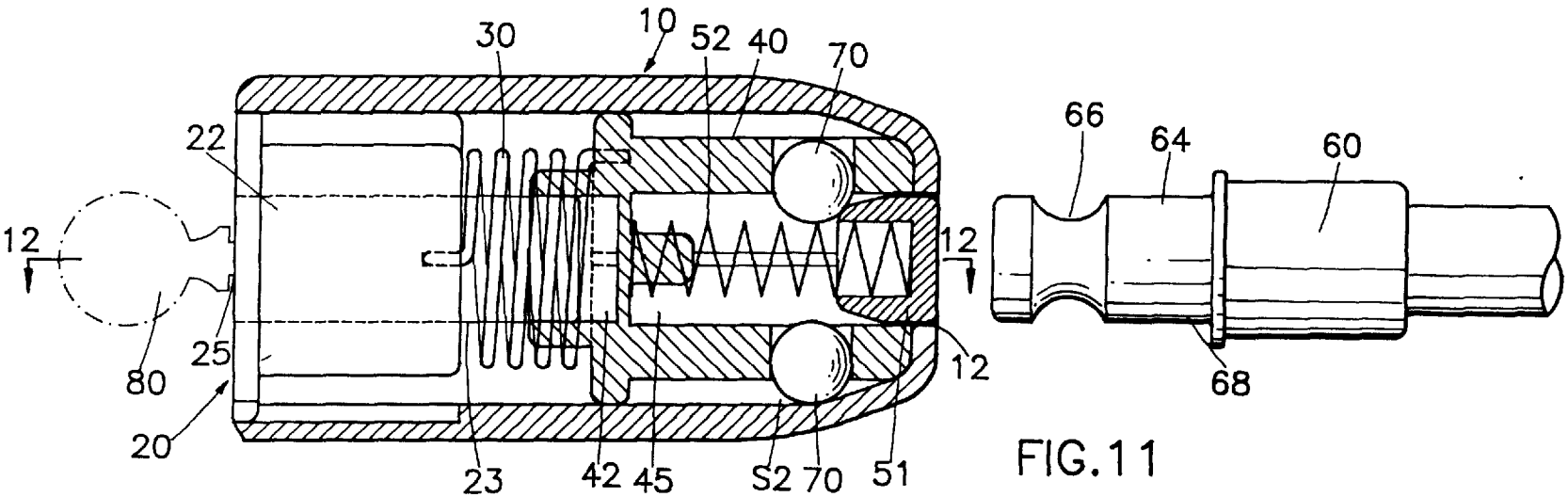
FIG. 11 is a longitudinal sectional diagram of the same shown in FIG. 10 except for that herein the locking head has been pushed to the outside of the main body.
Figure 12:
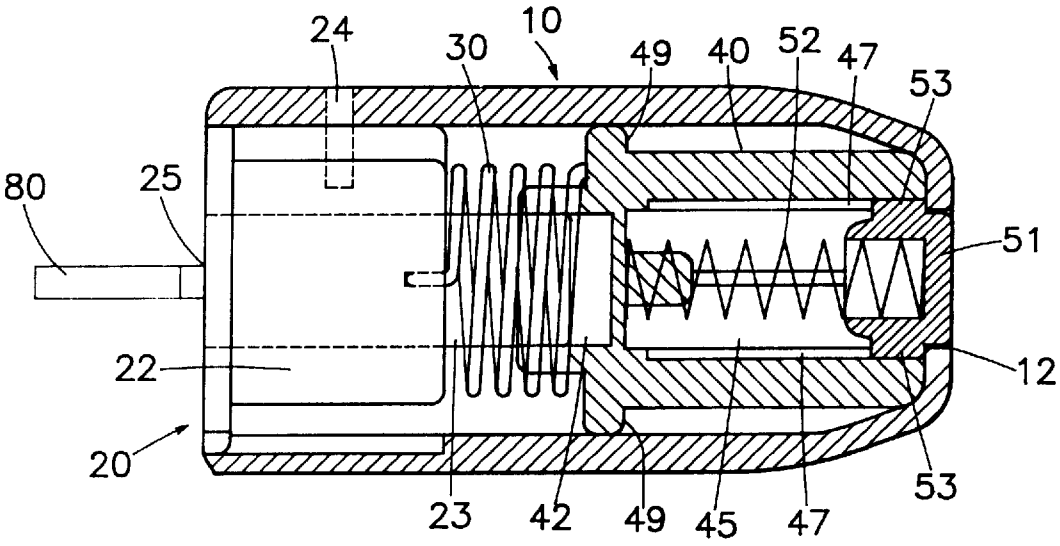
FIG. 12 is another longitudinal sectional diagram of the cable locking device shown in FIG. 11 cutting through the line 12—12.

Referring to FIGS. 9 and 10, when the user wants to unlock the locking head 64 of the cable 60 from the locking mechanism 40, he/she needs just to insert the key 80 of the locking device into the key hole 25 in the locking core 20 and then turn the key 80. By turning the key 80, the inner cylinder 22 and the locking tongue 23 are turned, thereby allowing the locking mechanism 40 to be turned against the elastic force of the elastic member 30 to an unlocking position as illustrated in FIG. 9. When the locking mechanism 40 is turned to the unlocking position, the steel balls 70 inset in the ring slot 66 of the locking head 64 will be shifted angularly about the axis of the locking mechanism 40 over the wedge-like protrusions 14, causing the steel balls 70 to be shifted from the highest point to the lowest point of the wedge-like protrusions 14. As a result of this, an empty space S2 is formed between the steel balls 70 and the inner wall of the main body 10, as illustrated in FIG. 10. Under this condition, the elastic force applied by the spring 52 on the head pop-up mechanism 50 is released, thereby causing the urging member 51 and the locking head 64 to be axially pushed outwards and the steel balls 70 to be shifted toward the empty space S2 and entirely driven out of the head receptacle 45. As a result, the steel balls 70 can no longer latch the locking head 64, allowing the locking head 64 to be popped up by means of the elastic force from the spring 52 to the outside of the head hole 12, as illustrated in FIG. 11. The locking head 64 is thus separated from the main body 10. Due to the guide ears 53 formed on the urging member 51, the urging member 51 is unable to pass through the head hole 12 and thus stopped at the head hole 12, as illustrated in FIG. 12.

After the unlocking process is completed, the user can release the key 80. This allows the elastic force from the compressed elastic member 30 resulted from the earlier turning of the locking mechanism 40 to be released, thereby propelling the locking mechanism 40, the locking tongue 23, and the inner cylinder 22 back to their original positions in unlocking state. Then, the user can withdraw the key 80 from the key hole 25. The unlocking process is then completed.

In conclusion, the cable locking device of the invention disclosed above has several advantages over prior art.

First, the automatic pop-up feature allows the user to easily unfasten the cable from the main body of the locking device simply by holding the main body with one hand and then turning the key with the other hand. The locking head fastening the cable to the main body of the locking device can then be automatically pop up. The operation is thus very easy and convenient.

Second, the locking device of the invention allows the unfastened cable to be fastened and locked to the main body without having to use the key, allowing the cable locking device of the invention to be quickly put into use.

Third, the axial locking feature allows easy and convenient operation of the locking device to fasten the cable thereto, particular in the case of the main body being large in size or the cable being a chain of steel rings.

Fourth, the fastening head and locking head fixed to both ends of the cable are both rotatably fastened to the main body of the locking device, allowing the user to easily handle and operate the locking device of the invention.

Fifth, after the cable is unlocked from the main body, all constituent parts in the main body are restored to ready positions that allow the user to refasten and lock the cable to the main body. The locking device of the invention is therefore very convenient to use.

Sixth, the use of the double-ball latching mechanism allows the latching effect on the locking head of the cable to be more securely enforced. The steel balls can be hardly unlatched by forcefully knocking on the main body by the thieves. The locking device of the invention is thus very reliable for use in preventing theft of the objects being locked thereby.

Seventh, the cable locking device of the invention is simple in structure and thus easy to manufacture. The manufacturing cost is thus low.

Eight, the cable locking device of the invention is more strengthened in structure and locking effect so that it would not be easily damaged by the thieves. The locking device of the invention is thus very reliable for use in preventing theft of the objects being locked thereby.

The invention has been described using exemplary preferred embodiments. However, it is to be understood that the scope of the invention is not limited to the disclosed embodiments. On the contrary, it is intended to cover various modifications and similar arrangements. The scope of the claims, therefore, should be accorded the broadest interpretation so as to encompass all such modifications and similar arrangements.

I claim:

1. A locking device, comprising:

a cable having a first end fixed to a fastening head and a second end fixed to a locking head having a ring slot formed around the surface thereof, a main body having a fastening means for fixedly fastening said fastening head of said cable thereto, said main body further being formed with a head hole which allows said locking head to pass therethrough to the inside of said main body and at least one wedge-like protrusion on the inner wall thereof near said head hole;

a locking core mounted in said main body, said locking core including an inner cylinder having a key hole for receiving a key of said locking device, said inner cylinder being connected to a locking tongue which is turnable when the key inserted in the key hole is turned;

a locking mechanism mounted in said main body, said locking mechanism having a hollowed inside partitioned by a separator into a tongue receptacle for receiving said locking tongue of said locking core therein and a head receptacle for receiving said locking head of said cable therein, said locking mechanism being formed with at least one ball hole used to hold a ball therein, said ball being abutted on said wedge-like protrusion on the inner wall of said main body when said locking mechanism is mounted in said main body;

an elastic member mounted in said main body between said locking core and said locking mechanism, said elastic member applying both a radial bias and an axial bias to said locking mechanism, the axial bias urging said locking mechanism toward said head hole while said radial bias urging said ball to be shifted to said wedge-like protrusion and intruding into the hollowed inside of said head receptacle, and a head pop-up mechanism mounted in said head receptacle in said locking mechanism, said head pop-up mechanism including an urging member and a compressed spring provided between said urging member and said separator, said spring applying a bias on said urging member toward said head hole;

wherein when said locking head is inserted into said head hole intending to fasten and lock said locking head to said locking mechanism, said ball is being supported by said wedge-like protrusion to have part intruding the hollowed inside of said head receptacle, thereby allowing said locking head to be shifted axially inwards by means of said urging member until said ball is shifted away from said wedgelike protrusion and retreated from said head receptacle, allowing said locking head to freely pass over said ball and entirely contained in said head receptacle, subsequently, when manual pushing force on said locking head is removed, said elastic member being released from compressed state to urge on and drive said locking mechanism back to original position, allowing said ball to again abut on said wedge-like protrusion and inset in said ring slot in the surface of said locking head, thereby latching said locking head securely in position, and wherein when the key of said locking device is inserted into the key hole in said inner cylinder and turned, said locking mechanism is turned correspondingly, allowing said ball to be shifted from the highest point of said wedge-like protrusion to the lowest point of said wedge-like protrusion and retreated from said head receptacle, allowing said compressed spring to be released and thus urge on said urging member to pop up said locking head to the outside of said main body.

2. The locking device of claim 1, wherein said locking head is formed with a flanged portion which serves as a stopper that limits the insertion depth of said locking head in said head receptacle.

3. The locking device of claim 1, wherein said wedge-like protrusion is formed with a radially inclined surface and an axially included surface.

4. The locking device of claim 1, wherein said locking mechanism is formed with a pair of radially symmetrical guide ears and correspondingly said main body is formed with a pair of guide grooves, which allow said locking mechanism to be slidably inserted into said main body and prevent said locking mechanism from shifting angularly about the axis of said main body.

5. The locking device of claim 1, wherein said urging member is formed with a pair of radially symmetrical guide ears and correspondingly said locking mechanism is formed with a pair of guide grooves, which allow said urging member to be slidable inserted into said locking mechanism.

6. The locking device of claim 1, wherein said fastening head of said cable is formed with a ring slot therearound; and said fastening means includes a plurality of pins which penetrate through holes formed in said main body to abut on said ring slot of said fastening head, allowing said first end to be rotatably fixed on said main body.

7. The locking device of claim 1, wherein said two ends of the cable are to be freely rotatable when the cable is in lock state allowing the user to easily and conveniently handle the locking device.

* * * * *